United States Patent [19]

Miller et al.

[11] 4,233,034

[45] Nov. 11, 1980

[54] DESULFURIZATION OF COAL

[75] Inventors: J. Wayne Miller, Yorba Linda, Calif.; Mark J. Anderson, St. Paul, Minn.

[73] Assignee: Union Oil Company of California, Brea, Calif.

[21] Appl. No.: 35,436

[22] Filed: May 3, 1979

[51] Int. Cl.[3] ..... C10L 9/02; C10B 57/00

[52] U.S. Cl. ..... 44/1 SR; 201/17

[58] Field of Search ..... 44/1 SR; 75/6; 201/17; 208/10

[56] References Cited

U.S. PATENT DOCUMENTS

| | | | |
|---|---|---|---|
| 3,846,275 | 11/1974 | Urban | 208/10 |
| 3,909,213 | 9/1975 | Sanders | 44/1 SR |
| 3,926,575 | 12/1975 | Meyers | 44/1 SR |
| 3,997,426 | 12/1976 | Montagna et al. | 208/10 |
| 4,007,108 | 2/1977 | Leas | 208/10 |
| 4,055,400 | 10/1977 | Stambaugh et al. | 44/1 SR |
| 4,071,328 | 1/1978 | Sinke | 44/1 SR |
| 4,083,696 | 4/1978 | Cole et al. | 44/1 SR |
| 4,155,832 | 5/1979 | Cox et al. | 208/10 |

*Primary Examiner*—Carl F. Dees

*Attorney, Agent, or Firm*—Dean Sandford; Cleveland R. Williams

[57] ABSTRACT

A process for reducing the amount of pyritic, organic and sulfate sulfur in coal and other carbonaceous materials by contacting sulfur-containing coal or carbonaceous material with hydrogen, transition metal salts and a buffer under increased temperature and pressure. Pyritic sulfides are reduced to ferrous sulfides and organic sulfides are converted to metal sulfides; the sulfides are, then, leached from the coal or carbonaceous material utilizing an acid solution. Alternatively, a metal compound may be added to the acid solution to promote the formation of hydrogen sulfide.

31 Claims, 1 Drawing Figure

DESULFURIZATION OF COAL

BACKGROUND OF THE INVENTION

1. Field of the Invention

Sulfur has always been an objectionable constituent of coal and other carbonaceous materials normally used to generate power and energy. With the rapidly diminishing oil supply and the present world-wide emphasis on the energy crisis, increased attention by both government and private organizations is being given to coal as an energy source. However, combustion of coal for heat, steam, and electrical power generation is by far the largest single source of atmospheric sulfur dioxide pollution in the United States, accounting for approximately two-thirds of the total sulfur oxide emissions.

Depending upon their origin, coals contain varying amounts of sulfur in the form of pyrite (iron disulfide), organic sulfur and sulfate sulfur from which sulfur dioxide is formed when coal is burned. Recent environmental considerations have led to legislation requiring the removal or substantial reduction of sulfur levels in fuels, such as coal, prior to their combustion. One of the principal drawbacks in the use of coals as a fuel source in the United States is due to their sulfur content which can range up to as high as ten percent. Hence, there is an ongoing search to convert coal directly into a usable fuel which would meet current air quality standards. The best processes which are known to the art, however, generally remove small levels of the total amount of sulfur in coal, especially organic sulfur compounds.

2. Brief Description of the Prior Art

The problem of separating sulfur and/or other impurities from coal and carbonaceous materials is not new and several processes have been extensively tested over the years. One such process is set forth in U.S. Pat. No. 4,083,696 which discloses a process for reducing the pyritic sulfur content of an aqueous coal slurry under conditions of turbulent flow through a pipeline. This is accomplished by introducing a pyrite oxidant into the pipeline upstream from a coal dewatering plant. Sutiable pyrite oxidants include hydrogen peroxide, ferric chloride, nitric acid, etc. The process is conducted at ambient pressure and at a temperature of from about 70° F. to about 100° F.

Another approach for separating sulfur from coal and carbonaceous materials is set forth in U.S. Pat. No. 3,909,213 which relates to a process for desulfurization of coal wherein coal and a Group IA or IIA metal oxide and a fused metal chloride salt are digested in a digestion zone. Representative examples of metal sulfides and metal chlorides include calcium or sodium oxide and zinc or ferric chloride.

U.S. Pat. No. 3,926,575 discloses a process for reducing a pyritic content of coal which comprises reacting finely divided coal with sulfuric or hydrochloric acid. An alternative method is disclosed for removing sulfur from coal which involves, in addition to an acid leach, a final extraction step involving use of a solvent, for example, benzene, etc.

U.S. Pat. No. 4,071,328 relates to a method of removing sulfur from coal which comprises hydrogenating the coal to remove a portion of sulfur therefrom. The hydrogenated coal is next contacted with an aqueous inorganic acid solution to remove some of the sulfur initially combined as pyritic sulfur.

It is readily apparent from the above that there is an ongoing search for newer, more efficient and more economical methods for removing sulfur from coal and carbonaceous materials.

SUMMARY OF THE INVENTION

The present invention resides in a process for the desulfurization of coal and other carbonaceous materials which contain pyritic sulfur, organic sulfur and sulfate sulfur which comprises: contacting an aqueous slurry of said coal or carbonaceous material with a transition metal salt, hydrogen and a buffer solution which buffers within the pH range of from about 4 to about 10, especially from about 5 to about 9, at a temperture of from about 200° F. to about 700° F., especially from about 300° F. to about 500° F. and a pressure of from about 100 psig to about 4000 psig, preferably from about 500 psig to about 1500 psig; and extracting the resultant metal sulfur compounds with an acidic solution; alternatively, a metal compound may be added to the acid extraction step to promote the release of hydrogen sulfide.

DETAILED DESCRIPTION OF THE DRAWING

Figure 1:
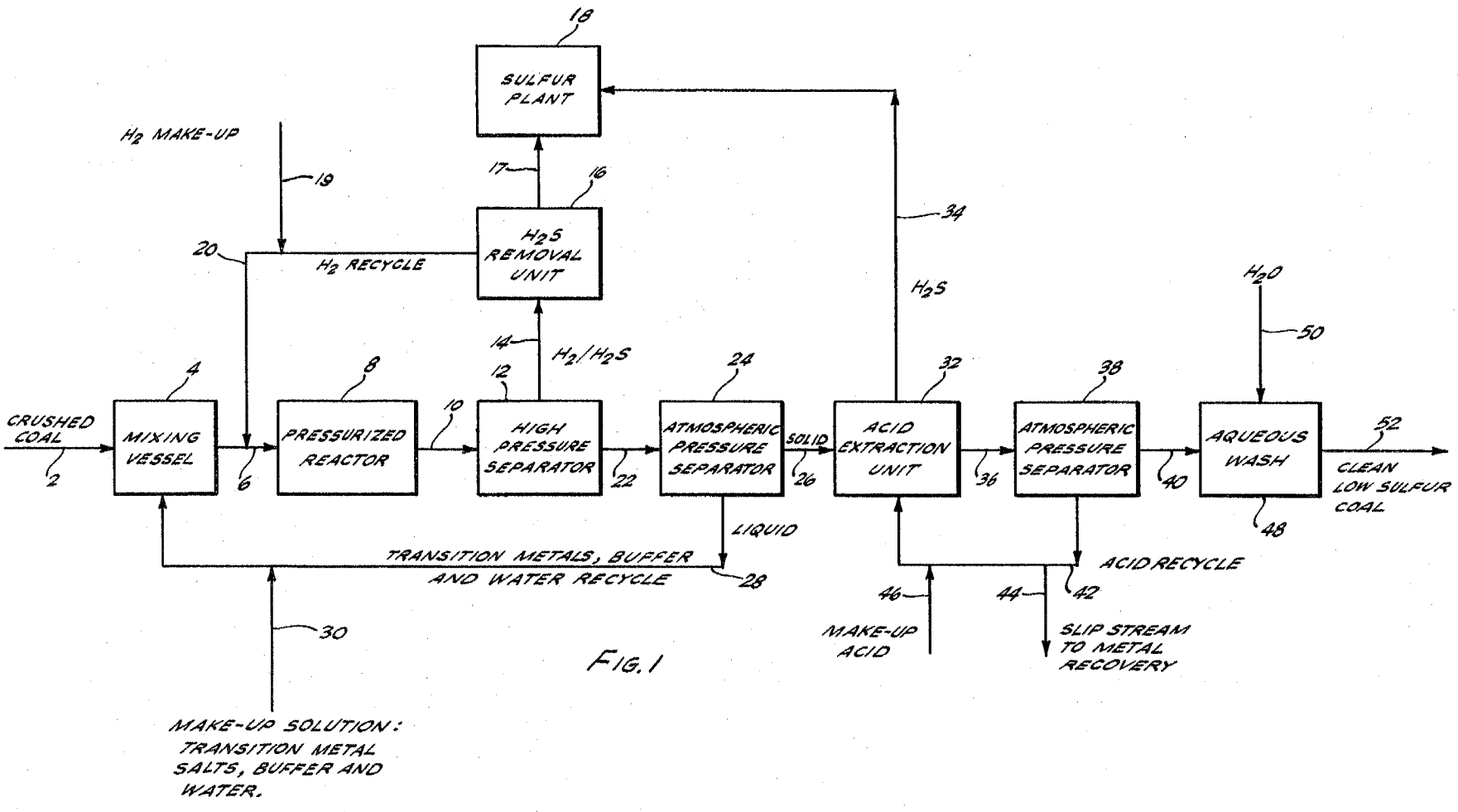

FIG. 1 is a schematic diagram of the process disclosed herein. An aqueous-crushed coal slurry is transported via conduit 2 to mixing vessel 4; transition metal salts, buffer and water are transported via conduit 28 to mixing vessel 4 where the content is mixed under atmospheric pressure, ambient temperature and agitation. The aqueous coal slurry including transition metal salts and buffer is transported through conduit 6 to pressurized reactor 8. Hydrogen is introduced into the system through conduit 19, conduit 20 and conduit 6 into pressurized reactor 8 where the pyritic sulfur is reduced to ferrous sulfide by hydrogen and organic sulfur reacts with the transition metal to form a metal sulfide. The solid-liquid slurry is agitated in pressurized reactor 8 at a pressure of from about 100 psig to about 1000 psig and a temperature of from about 200° F. to about 700° F. for about 30 minutes to about 25 hours.

Next, the solid-liquid slurry is introduced into high pressure separator unit 12 through conduit 10 where the gaseous phase of hydrogen sulfide produced in pressurized reactor 8 and hydrogen reducing gas are stripped from the solid-liquid slurry. Hydrogen sulfide and hydrogen are transported through conduit 14 to $H_2S$ removal unit 16, where hydrogen sulfide is separated from hydrogen and transported via conduit 17 to sulfur plant 18 where sulfur is recovered. Hydrogen gas is recirculated through conduit 20 and conduit 6 to pressurized reactor 8 where it reduces pyritic sulfur to ferrous sulfide. Make-up hydrogen is introduced into conduit 19, through conduits 20 and 6 to maintain the process pressure and replace hydrogen consumed in the reactions.

The solid-liquid slurry, including buffer and transition metal salts, is transferred through conduit 22 to atmospheric pressure separator 24 where coal is separated from the liquid and transported to acid extraction unit 32. The liquid, including buffer, transition metals (salts) and water, is recirculated through conduit 28 to mixing vessel 4. Make-up, transition metal salts, buffer and water are introduced into the system through conduits 30 and 28 into mixing vessel 4 to replace any reactants consumed in the reaction.

Coal is reacted with an acid in acid extraction unit 32 to extract metal sulfides, recover metals and release sulfur as hydrogen sulfide ($H_2S$). Hydrogen sulfide is transported through conduit 34 to sulfur plant 18 where sulfur is recovered. The extracted coal and acid are transferred to separator unit 38 through conduit 36 where coal is separated from the acid and transported through conduit 40 to wash unit 48. Acid is recirculated to extraction unit 32 through line 42 to recover metals and release sulfur as hydrogen sulfide. Metal is transferred to metal recovery facilities through conduits 42 and 44. Make-up acid is introduced into the system through conduit 46 to replace acid consumed in extraction unit 32.

Water is transported through conduit 50 to wash unit 48 where the coal is washed to remove entrained acid and any other undesirable component. Clean, low-sulfur coal is transported to storage facilities through conduit 52.

DESCRIPTION OF THE INVENTION

The present invention resides in a process for desulfurizing coal and other carbonaceous materials using a buffer which buffers within the pH range of from about 4 to about 10, especially from about 5 to about 9, in combination with a transition metal salt, hydrogen and an acid solution. The sulfur content of coals located in the United States ranges from a low of about 0.2% to a high of as much as 7% assumed. Generally, sulfur does not occur as an element in coal, however, three forms of sulfur in chemical combination are recognized. A major portion of the sulfur, approximately 40% to 80%, occurs as a constituent of pyrite and marcasite. These polysulfides are deposited as famboids in peat and are formed by the reaction between ferrous ions in solution and hydrogen sulfide which is derived from the anerobic action of bacteria on sulfates. The remainder of sulfur occurs as hydrous ferrous sulfate derived by weathering of pyrites as gypsum and as organic sulfur in combination with coalformed vegetal material (macerals). The amount of sulfate sulfur contained in coal is very small, generally less than 0.1%. Organic sulfur is presumed to exist as sulfides, disulfides, mercaptans, and heterocyclic rings, for example, thiophene.

Sulfur bonded in organic and pyritic compounds is converted into a sulfide compound which may be extracted or leached from the coal with an acid. Particularly, metal ions are transported to the organic sulfur sites situated in the coal or carbonaceous material matrix as cations whose small atomic radii penetrate the fine pore structure of said coal or carbonaceous material. Metal salts are reduced in situ to the elemental metal utilizing a reducing gas atmosphere, for example hydrogen. High surface area metals are distributed through the coal particles and react with the maceral sulfur to form metal sulfides. The metal sulfide compounds thus formed are removed by extraction with an acidic compound or solution. Extraction of the metal sulfides with an acidic compound results in redissolution of the metal salts and the release of sulfur as hydrogen sulfide. The hydrogen sulfide is, then, sent to a hydrogen sulfide absorbing solution, for example an amine solution, where hydrogen sulfide is recovered. Alternatively, a metal compound may be added to the acid extraction step to promote the release of hydrogen sulfide.

Anthracitic materials, bituminous and subbituminous coal, lignitic material, peat, coke and other types of coal products referred to in ASTM Designation: D-388-66 (reapproved 72) are exemplary of the solid carbonaceous materials which may be treated in accordance with the process of the present invention to produce a low sulfur fuel therefrom. The coal, prior to use in the process of the invention, is preferably pulverized in a suitable attrition machine, for example, a hammermill, etc. to a size such at least 90 percent of the coal will pass through a 200 mesh (U.S. Series) sieve. The ground coal is then slurried in a suitable solvent, for example water or a water-alcohol mixture, before introduction into a pressurized reaction vessel to be contacted with other components to promote sulfur removal therefrom.

Coals and other solid carbonaceous materials that may be used herein, include any high sulfur coal or carbonaceous material, preferably of the following composition on a moisture-free basis:

TABLE I

| | Weight Percent | |
|---|---|---|
| | Broad Range | Normal Range |
| Carbon | 45–95 | 60–92 |
| Hydrogen | 2.5–7.0 | 4.0–6.0 |
| Oxygen | 2.0–45 | 3.0–25 |
| Nitrogen | 0.75–2.5 | 0.75–2.5 |
| Sulfur | 0.3–10 | 0.5–6.0 |

Illustrative examples of coals or other carbonaceous materials which may be treated in accordance with the present invention include lignite as set forth in Table II below:

TABLE II

| LIGNITE | |
|---|---|
| ELEMENT | ANALYSIS % BY WT. |
| Carbon | 64.41 |
| Hydrogen | 4.41 |
| Nitrogen | 0.99 |
| Oxygen | 17.42 |
| Sulfur | 0.43 |
| Ash | 12.34 |

Pittsburgh seam coal as set forth below in Table III:

TABLE III

| PITTSBURGH SEAM COAL | |
|---|---|
| ELEMENT | ANALYSIS % BY WT. |
| Carbon | 76.84 |
| Hydrogen | 5.06 |
| Nitrogen | 1.61 |
| Oxygen | 8.19 |
| Sulfur | 1.49 |
| Ash | 8.28 |

Kentucky coal as set forth in Table IV below:

TABLE IV

| KENTUCKY COAL | |
|---|---|
| ELEMENT | ANALYSIS % BY WT. |
| Carbon | 68.53 |
| Hydrogen | 4.60 |
| Nitrogen | 1.42 |
| Oxygen | 5.82 |
| Sulfur | 4.63 |
| Ash | 15.00 |

And Indiana #3 coal as set forth in Table V below:

TABLE V

| INDIANA #3 COAL | |
|---|---|
| ELEMENT | ANALYSIS % BY WT. |
| Carbon | 65.2 |
| Hydrogen | 4.9 |
| Nitrogen | 1.05 |
| Oxygen | 6.95 |
| Sulfur | 4.32 |
| Ash | 17.57 |

It is to be noted that the sulfur content of the above described coals may vary greatly even in one particular coal field and the above coals are illustrative of coals that may be treated in accordance with the process herein.

A coal selected from the group consisting of anthracite, bituminous, sub-bituminous, lignite, etc., or other carbonaceous material described in ASTM Designation: D-388-66 (reapproved 72) is crushed to a suitable particle size using conventional apparatus. A desirable particle size range is from about 60 to about 400 standard mesh, preferably from about 100 to about 300 standard mesh, especially where 90% of the solids pass through a 200 standard mesh sieve.

The coal is blended with an aqueous media or solution to prepare a slurry. Normally, the weight ratio of aqueous solution and coal is from about 20:1 to about 1:15 especially from about 10:1 to about 4:1. The aqueous solution may comprise either water or a water-alcohol mixture. When a water-alcohol mixture is used, the water to alcohol volume ratio is generally from about 10:1 to about 1:10, preferably from about 5:1 to about 1:5. Any water soluble alcohol may be used in the present process, the only criteria is that the alcohol be substantially compatible with water. Illustrative examples of suitable alcohols include: methanol, ethanol, propanol, butanol, isopropanol, etc.

The aqueous coal slurry is then transferred to a pressure reaction vessel, which will withstand increased temperature and pressure. The reaction vessel used herein may be any suitable reaction vessel normally used in the art.

Hydrogen, a buffer and a transition metal salt are introduced into the reaction vessel to promote the reduction of the transitional metal salt to the elemental metal by hydrogen and the reaction of the elemental metal ions with organic sulfur combined with the coal. The hydrogen pressure may be any pressure above atmospheric pressure. It is to be noted, however, that desulfurization efficiency is increased when the pressure is maintained at about 100 psig to about 4000 psig, especially from about 500 psig to about 1500 psig.

The term buffer as used herein means a compound or mixture of compounds capable in solution of neutralizing both acids and bases, thereby maintaining the original hydrogen-ion concentration of a particular solution. Normally, the buffer is selected from a solution comprising a weak acid plus the salt of a weak acid or a weak base plus the salt of a weak base depending upon the type transition metal salt used in the process. However, any compound or mixture of compounds which maintain the reaction pH at the desired level and do not adversely effect the reaction may be used in the desulfurization process herein.

Buffers suitable for use, generally, are those compounds which buffer within the pH range of from about 4 to about 10, preferably from about 5 to about 9. Illustrative compounds include ammonium acetate, ammonium hydroxide, acetic acid, sodium acetate, ammonium chloride, etc., and mixtures thereof. The amount of buffer added to the reaction mixture will depend upon the type transition metal used, reaction temperature and the like. Thus, the amount of buffer used will vary according to these parameters.

Metals suitable for use in the present invention preferably are transition metals capable of being reduced by a reducing gas such as hydrogen. Transition metals which may be used in our process include iron, cobalt, nickel, ruthenium, rhodium, palladium, osmium, iridium, or platinum and mixtures thereof. Normally, the transition metals are introduced into the reaction vessel in salt form. Suitable transition metal salts are preferably selected from the group soluble in water, for example, the transition metal nitrates, acetates, formates, chlorides, bromides, fluorides and iodides. Illustrative examples of transition metal salts suitable for use herein include nickel acetate, nickel formate, nickel nitratehexahydrate, nickel chloride, nickel bromide, nickel fluoride, nickel iodide, ferric acetate, ferric formate, ferric nitrate, ferric chloride, ferric bromide, ferric fluoride, ferric iodide, cobalt acetate, cobalt formate, cobalt nitrate, cobalt chloride, cobalt bromide, cobalt fluoride, cobalt iodide and mixtures thereof. Normally, the transition metal salt is mixed in sufficient amount with the coal or carbonaceous material to provide a metal to sulfur atomic ratio of from about 10:1 to about 1:1, especially from about 4:1 to about 2:1.

The reaction temperature is maintained using any suitable heating apparatus, for example, a furnace, electrical heater or the like. The temperature at which the reaction is carried out, normally, is within the range of from about 200° F. to about 700° F., preferably from about 300° F. to about 650° F., for about 30 minutes to about 25 hours, especially for about 30 minutes to about 5 hours. It is obvious that the temperature is maintained at a level which will promote reaction of the various constituents in the reaction vessel while minimizing the loss of coal as volatiles and excessive caking of the coal or carbonaceous material. Similarly, the reaction time may vary over a wide period of time depending upon such variables as temperature, pressure, the buffer, type transition metal or acid used in the reaction. A portion of the sulfur is converted, at this stage of the process, to hydrogen sulfide which is transported to hydrogen sulfide removing apparatus, for example an amine absorbing solution, where hydrogen sulfide is removed and hydrogen is recycled to react with additional crushed coal or carbonaceous material and other reaction constituents.

Next, the crushed coal, including aqueous solvent, is filtered, to separate coal from the liquid, and directed to an acid extraction reaction, where sulfur combined as ferrous sulfide and organic sulfur converted to metal sulfide is released from the coal as hydrogen sulfide and the metals are solubilized in the acid solution. The sulfur content of coals herein was determined in accordance with the procedure of ASTM Designation: D-2492-68 (reapproved 72).

Normally, the acid is combined with coal or carbonaceous material at a weight ratio of from about 20:1 to about 1:1, preferably from about 10:1 to about 2:1. A wide variety of acids may be used in the extraction of sulfur from coal herein, however, mineral acids give superior results and are the preferred acids. Acids suitable for use in the present process include hydrochloric acid, nitric acid, phosphoric acid, sulfuric acid, or acetic acid and mixtures thereof.

Alternatively, a metal may be added to the acid extraction reaction to promote the formation of hydrogen sulfide. The addition of a metal to the acid extraction reaction is not essential to the formation of hydrogen sulfide and the removal of sulfur. However, it acts as a promoter, which serves to speed up the hydrogen sulfide formation reaction. Suitable metals include iron, cobalt, nickel, ruthenium, rhodium, palladium, osmium, iridium, or platinum and mixtures thereof. The coal or carbonaceous material and acid are contacted with the metal in an atomic ratio of metal to sulfur of from about 10:1 to about 1:1, preferably from about 4:1 to about 2:1.

The acid extraction may be conducted at a temperature ranging from ambient temperature up to about 300° F., especially from about 100° F. to about 200° F., and a pressure of from about atmospheric pressure to about 100 psig, preferably at atmospheric pressure. Additionally, the reaction temperture and pressure of the acid extraction step may be identical to or different from the temperature and pressure of the reaction step of the process, for example the temperature and pressure may be either higher or lower in the reaction phase of the process, i.e., where transition metal salts are reacted with the maceral sulfur of cola, as compared to the acid extraction phase of the process. The extracted sulfur is, next, directed to a hydrogen sulfide absorber; the acid is recycled to extract additional sulfur. The coal or carbonaceous material thus recovered has a low sulfur content.

DESCRIPTION OF THE PREFERRED EMBODIMENTS

The following Examples serve to further illustrate and instruct one skilled in the art the best mode of how to practice this invention and are not intended to be construed as limiting thereof.

EXAMPLE I

To a one liter pressure resistant autoclave with heating means, was added an aqueous slurry of Indiana #3 coal which comprised 100 grams of coal containing 4.32% sulfur by weight, which had been pulverized to 200/270 standard mesh, and 500 cc of water. The reactor was pressurized with hydrogen to 750 psig and heated at 600° F. for twelve hours with agitation. Upon opening the autoclave, we noted that the coal had retained its solid form and could easily be filtered from the aqueous phase. The coal was extracted with 200 cc of an aqueous 20% (weight) hydrochloric acid at 200° F. for 30 minutes and analyzed for sulfur content according to the procedure of ASTM Designation: D-2492-68. The analytical results indicated that the treated coal, without using a transitional metal salt, contained about 2.4% sulfur (moisture-free basis) which was about equivalent to the level of organic sulfur in the untreated coal, only 44% of the sulfur was removed from the coal. A substantial portion of the inorganic sulfur was removed, however, essentially none of the organic sulfur was removed.

The Example does not utilize a transition metal salt or a buffer in the reaction and serves as a control to compare with the other Examples. A more detailed comparison of sulfur removal from coal is set forth in Table VI.

EXAMPLE II

A one liter autoclave was loaded with 50 grams of Indiana #3 coal containing 4.32% by weight as sulfur, which had been previously ground to 200/270 standard mesh, and 500 cc of an aqueous 2% (weight) ammonium acetate solution. Next, 33.1 grams of nickel acetate [as $Ni(C_2H_3O_2)_2.4H_2O$] was added to the aqueous phase. The atomic ratio of nickel to sulfur was 2/1. The autoclave pressure was increased to 500 psig using hydrogen, and the temperature was increased to 415° F.; the reaction was allowed to proceed for fifteen hours with agitation. After allowing the autoclave to cool, the coal was removed from the other constituents by filtration and transported to an extracting apparatus where it was extracted with 200 cc of an aqueous 20% solution of hydrochloric acid. Analysis of the treated coal, using the procedure of Example I, indicated that 56% of the sulfur was removed (See Table VI).

EXAMPLE III

A one liter autoclave was loaded with 50 grams of Indiana #3 coal containing 4.32% by weight sulfur, which had previously been pulverized to 200/270 standard mesh, and 500 cc of an aqueous 2% (weight) ammonium acetate solution. Nickel acetate (32.1 grams) was added to the aqueous phase to adjust the nickel to sulfur ratio in the coal to 2/1. The autoclave was pressurized to 500 psig with hydrogen and the temperature was increased to 410° F. for five hours and 495° F. for 15 hours with agitation. After cooling, the coal was removed from the other constituents by filtration and transported to an extraction vessel where it was extracted at 200° F. with 200 cc of an aqueous 20% (weight) solution of hydrochloric acid. Five grams of iron filings were added to the extraction vessel to increase the rate of removal of hydrogen sulfide from the nickel sulfate. An analysis of the treated coal indicated that 65% of the sulfur was removed.

EXAMPLE IV

The procedure of Example II was followed with the following exceptions: an aqueous solution comprising 500 cc of 0.6% (weight) ammonium hydroxide and 38.5 grams of cobalt nitrate [as $Co(NO_3)_2.6H_2O$] was utilized; the atomic ratio of cobalt to sulfur in the coal was adjusted to 2/1. The vessel temperature was increased to 330° F. for five hours and 615° F. for twenty hours with agitation. An analysis indicated that 72% of the sulfur was removed.

EXAMPLE V

Sulfur was removed from coal containing 4.32% sulfur by charging to an autoclave 50 grams of coal pulverized to 200/270 standard mesh and 500 cc of an aqueous 3% (weight) ammonium hydroxide solution. Ferric nitrate [53.1 grams as $Fe(NO_3)_3.9H_2O$] was added to the autoclave to adjust the iron to sulfur molar ratio to 2/1. The autoclave was pressurized to 500 psig with hydrogen and the temperature was increased to 390° F. for five hours and 530° F. for fifteen hours with agitation. After cooling, the coal was removed from the other reactants and transported to an extraction vessel where it was extracted at 100° F. with an aqueous solution of 20% by weight of hydrochloric acid. An analysis of the treated coal indicated that 56% of the sulfur was removed from the coal.

The sulfur removal data of Examples I to V were compiled for comparison purposes. The results are disclosed in Table VI below:

TABLE VI

| Example | Additive | Sulfur Removal from Coal | | |
|---|---|---|---|---|
| | | % Total | % Inorganic | % Organic |
| I | None | 44 | 92 | 0 |
| II | Nickel Acetate | 56 | 100 | 16 |
| III | Nickel Acetate | 65 | 100 | 33 |
| IV | Cobalt Nitrate | 72 | 100 | 47 |
| V | Ferric Nitrate | 56 | 100 | 16 |

As can readily be determined from the above, 100 percent of the inorganic sulfur and substantial portions of the organic sulfur in coal was removed when coal was treated in accordance with the process.

Obviously, many modifications and variations of the invention, as hereinabove set forth, may be made without departing from the spirit and scope thereof, and therefore only such limitations should be imposed as are indicated in the appended claims.

We claim:

1. A process for desulfurizing coal and other carbonaceous materials which contain pyritic sulfur, organic sulfur and sulfate sulfur which comprises: contacting an aqueous slurry of said coal or carbonaceous material with a transition metal salt, hydrogen and a buffer that buffers within the pH range of from about 4 to about 10 under reaction conditions; and contacting said coal or carbonaceous material with an acid.

2. The process according to claim 1 wherein the coal or carbonaceous material is pulverized to a particle size range of from about 60 to about 400 standard mesh.

3. The process according to claim 1 wherein the aqueous slurry comprises water and coal or carbonaceous material in a weight ratio of from about 20:1 to about 1:1.

4. The process according to claim 1 wherein the aqueous slurry comprises a water-alcohol mixture and coal or carbonaceous material in a weight ratio of from about 20:1 to about 1:1.

5. The process according to claim 4 wherein water and alcohol are in a molar ratio of from about 10:1 to about 1:10.

6. The process according to claim 5 wherein the alcohol is a member selected from the group consisting essentially of: methanol, ethanol, propanol, butanol or isopropanol and mixtures thereof.

7. The process according to claim 1 wherein the buffer is selected from the group consisting essentially of ammonium acetate, ammonium hydroxide, sodium acetate, acetic acid, or ammonium chloride and mixtures thereof.

8. The process according to claim 1 wherein the transition metal salt contains a metal selected from the group consisting of iron, cobalt, nickel, ruthenium, rhodium, palladium, osmium, iridium or platinum and mixtures thereof.

9. The process according to claim 1 wherein the transition metal salt is a member selected from the group consisting of: nickel acetate, nickel formate, nickel nitratehexahydrate, nickel chloride, nickel bromide, nickel fluoride, nickel iodide, ferric acetate, ferric formate, ferric nitrate, ferric chloride, ferric bromide, ferric fluoride, ferric iodide, cobalt acetate, cobalt formate, cobalt nitrate, cobalt chloride, cobalt bromide, cobalt fluoride, or cobalt iodide and mixtures thereof.

10. The process according to claim 1 wherein the transition metal salt is mixed with the coal or carbonaceous material in sufficient amount to provide a metal to organic sulfur atomic ratio of from about 10:1 to about 1:1.

11. The process according to claim 1 wherein the reaction conditions have a temperature of from about 200° F. to about 700° F. and a pressure of from about 100 psig to about 4000 psig.

12. The process according to claim 1 wherein the acid is a member selected from the group consisting essentially of: hydrochloric acid, nitric acid, phosphoric acid, sulfuric acid or acetic acid and mixtures thereof.

13. The process according to claim 1 wherein the acid and coal or carbonaceous material are mixed in a weight ratio of from about 20:1 to about 1:1.

14. The process according to claim 1 wherein the coal or carbonaceous material is contacted with an acid at a temperature of from ambient temperature to about 300° F. and a pressure of from about atmospheric pressure to about 100 psig.

15. The process according to claim 1 wherein the coal or carbonaceous material is contacted with an acid in the presence of a metal selected from iron, cobalt, nickel, ruthenium, rhodium, palladium, osmium, iridium, or platinum and mixtures thereof.

16. The process according to claim 14 wherein the coal or carbonaceous material and acid are contacted with a metal in an atomic ratio of metal to sulfur of from about 10:1 to about 1:1.

17. A process for desulfurizing coal and other carbonaceous materials which contain pyritic sulfur, organic sulfur and sulfate sulfur which comprises contacting an aqueous slurry of said coal or carbonaceous material, a transition metal salt, hydrogen, and a buffer that buffers within the pH range of from about 4 to about 10 at a temperature of from about 200° F. to about 450° F. and a pressure of from about 100 psig to about 4000 psig, for about 30 minutes to about 5 hours, raising the temperature from about 450° F. to about 700° F. for about 30 minutes to about 25 hours; and contacting said coal or carbonaceous material with an acid.

18. The process according to claim 17 wherein the coal or carbonaceous material is pulverized to a particle size range of from about 60 to about 400 standard mesh.

19. The process according to claim 17 wherein the aqueous slurry comprises water and coal or carbonaceous material in a volume ratio of from about 20:1 to about 1:1.

20. The process according to claim 17 wherein the aqueous slurry comprises a water-alcohol mixture and coal or carbonaceous material in a volume ratio of from about 20:1 to about 1:1.

21. The process according to claim 20 wherein water and alcohol are in a molar ratio of from about 10:1 to about 1:10.

22. The process according to claim 20 wherein the alcohol is a member selected from the group consisting essentially of: methanol, ethanol, propanol, butanol, or isopropanol and mixtures thereof.

23. The process according to claim 17 wherein the buffer is selected from the group consisting essentially of ammonium acetate, ammonium hydroxide, sodium acetate, acetic acid or ammonium chloride and mixtures thereof.

24. The process according to claim 17 wherein the transition metal salt contains a metal selected from the group consisting of iron, cobalt, nickel, ruthenium, rohdium, palladium, osmium, iridium or platinum and mixtures thereof.

25. The process according to claim 17 wherein the transition metal salt is a member selected from the group consisting of nickel acetate, nickel formate, nickel nitratehexahydrate, nickel chloride, nickel bromide, nickel fluoride, nickel iodide, ferric acetate, ferric formate, ferric nitrate, ferric chloride, ferric bromide, ferric fluoride, ferric iodide, cobalt acetate, cobalt formate, cobalt nitrate, cobalt chloride, cobalt bromide, cobalt fluoride, or cobalt iodide and mixtures thereof.

26. The process according to claim 17 wherein the transition metal salt is mixed with the coal or carbonaceous material in sufficient amount to provide a metal to organic sulfur atomic ratio of from about 10:1 to about 1:1.

27. The process according to claim 17 wherein the acid is a member selected from the group consisting essentially of: hydrochloric acid, nitric acid, phosphoric acid, sulfuric acid or acetic acid and mixtures thereof.

28. The process according to claim 17 wherein the acid and coal or carbonaceous material are mixed in a weight ratio of from about 20:1 to about 1:1.

29. The process according to claim 17 wherein the coal or carbonaceous material is contacted with an acid at a temperature of from ambient temperature to about 300° F. and a pressure of from about atmospheric pressure to about 100 psig.

30. The process according to claim 17 wherein the coal or carbonaceous material is contacted with an acid in the presence of a metal selected from iron, cobalt, nickel, ruthenium, rhodium, palladium, osmium, iridium, or platinum and mixtures thereof.

31. The process according to claim 17 wherein the coal or carbonaceous material and acid are contacted with a metal in an atomic ratio of metal to sulfur of from about 10:1 to about 1:1.

* * * * *